US006753814B2

(12) United States Patent
Killen et al.

(10) Patent No.: US 6,753,814 B2
(45) Date of Patent: Jun. 22, 2004

(54) DIPOLE ARRANGEMENTS USING DIELECTRIC SUBSTRATES OF META-MATERIALS

(75) Inventors: William D. Killen, Melbourne, FL (US); Randy T. Pike, Grant, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/184,332

(22) Filed: Jun. 27, 2002

(65) Prior Publication Data

US 2004/0001027 A1 Jan. 1, 2004

(51) Int. Cl.[7] ..... H01Q 1/38

(52) U.S. Cl. ..... 343/700 MS; 343/821; 343/793

(58) Field of Search ..... 343/700 MS, 702, 343/793, 895, 904, 893, 785, 821, 820, 822

(56) References Cited

U.S. PATENT DOCUMENTS

| | | | | |
|---|---|---|---|---|
| 3,571,722 | A | 3/1971 | Vendelin | 325/445 |
| 3,678,418 | A | 7/1972 | Woodward | 333/26 |
| 4,495,505 | A | 1/1985 | Shields | 343/821 |
| 4,525,720 | A | 6/1985 | Corzine et al. | 343/895 |
| 4,800,344 | A | 1/1989 | Graham | 333/25 |
| 4,825,220 | A | 4/1989 | Edward et al. | 343/795 |
| 4,882,553 | A | 11/1989 | Davies et al. | 333/26 |
| 4,916,410 | A | 4/1990 | Littlefield | 330/295 |
| 4,924,236 | A | 5/1990 | Schuss et al. | 343/700 MS |
| 5,039,891 | A | 8/1991 | Wen et al. | 333/25 |
| 5,148,130 | A | 9/1992 | Dietrich | 307/529 |
| 5,379,006 | A | 1/1995 | McCorkle | 333/26 |
| 5,455,545 | A | 10/1995 | Garcia | 333/26 |
| 5,523,728 | A | 6/1996 | McCorkle | 333/128 |
| 5,678,219 | A | 10/1997 | Agarwal et al. | 455/280 |
| 6,052,039 | A | 4/2000 | Chiou et al. | 333/100 |
| 6,114,940 | A | 9/2000 | Kakinuma et al. | 336/233 |
| 6,133,806 | A | 10/2000 | Sheen | 333/26 |
| 6,137,376 | A | 10/2000 | Imbornone et al. | 333/25 |
| 6,184,845 | B1 | 2/2001 | Leisten et al. | 343/895 |
| 6,307,509 | B1 | 10/2001 | Krantz | 343/700 |
| 6,501,425 | B1 * | 12/2002 | Nagumo et al. | 343/700 MS |

OTHER PUBLICATIONS

U.S. patent application Ser. No. 10/448,973, Delgado et al., filed May 30, 2003.
U.S. patent application Ser. No. 10/184,277, Killen et al., filed Jun. 27, 2002.
U.S. patent application Ser. No. 10/185,443, Killen et al., filed Jun. 27, 2002.
U.S. patent application Ser. No. 10/185,251, Parsche et al., filed Jun. 27, 2002.
U.S. patent application Ser. No. 10/185,847, Killen et al., filed Jun. 27, 2002.
U.S. patent application Ser. No. 10/185,275, Killen et al., filed Jun. 27, 2002.
U.S. patent application Ser. No. 10/185,273, Killen et al., filed Jun. 27, 2002.

(List continued on next page.)

*Primary Examiner*—James Clinger
(74) *Attorney, Agent, or Firm*—Sacco & Associates, PA

(57) ABSTRACT

The invention concerns a dipole antenna of reduced size and with improved impedance bandwidth. The antenna is preferably formed on a dielectric substrate having a plurality of regions, each having a characteristic relative permeability and permittivity. First and second dipole radiating element defining conductive paths can be selectively formed on first characteristic regions of the substrate having a first characteristic permeability and first permittivity. A reactive coupling element can be interposed between the dipole radiating elements for reactively coupling the first dipole radiating element to the second dipole radiating element.

20 Claims, 6 Drawing Sheets

OTHER PUBLICATIONS

U.S. patent application Ser. No. 10/308,500, Killen et al., filed Dec. 3, 2002.
U.S. patent application Ser. No. 10/373,935, Killen et al., filed Feb. 25, 2003.
U.S. patent application Ser. No. 10/404,285, Killen et al., filed Mar. 31, 2003.
U.S. patent application Ser. No. 10/404,981, Killen et al., filed Mar. 31, 2003.
U.S. patent application Ser. No. 10/404,960, Killen et al., filed Mar. 31, 2003.
U.S. patent application Ser. No. 10/185,144, Killen et al., filed Jun. 27, 2002.
U.S. patent application Ser. No. 10/185,266, Killen et al., filed Jun. 27, 2002.
U.S. patent application Ser. No. 10/185,162, Rumpf Jr. et al., filed Jun. 27, 2002.
U.S. patent application Ser. No. 10/185,824, Killen et al., filed Jun. 27, 2002.
U.S. patent application Ser. No. 10/185,187, Killen et al., filed Jun. 27, 2002.
U.S. patent application Ser. No. 10/185,855, Killen et al., filed Jun. 27, 2002.
U.S. patent application Ser. No. 10/185,459, Killen et al., filed Jun. 27, 2002.
U.S. patent application Ser. No. 10/185,480, Killen et al., filed Jun. 27, 2002.
U.S. patent application Ser. No. 10/439,094, Delgado et al., filed May 15, 2003.

* cited by examiner

DIPOLE ARRANGEMENTS USING DIELECTRIC SUBSTRATES OF META-MATERIALS

BACKGROUND OF THE INVENTION

1. Statement of the Technical Field

The inventive arrangements relate generally to methods and apparatus for providing increased design flexibility for RF circuits, and more particularly for optimization of dielectric circuit board materials for improved performance.

2. Description of the Related Art

RF circuits, transmission lines and antenna elements are commonly manufactured on specially designed substrate boards. For the purposes of these types of circuits, it is important to maintain careful control over impedance characteristics. If the impedance of different parts of the circuit do not match, this can result in inefficient power transfer, unnecessary heating of components, and other problems. Electrical length of transmission lines and radiators in these circuits can also be a critical design factor.

Two critical factors affecting the performance of a substrate material are dielectric constant (sometimes called the relative permittivity or $\in_r$) and the loss tangent (sometimes referred to as the dissipation factor). The relative permittivity determines the speed of the signal in the substrate material, and therefore the electrical length of transmission lines and other components implemented on the substrate. The loss tangent characterizes the amount of loss that occurs for signals traversing the substrate material. Losses tend to increase with increases in frequency. Accordingly, low loss materials become even more important with increasing frequency, particularly when designing receiver front ends and low noise amplifier circuits.

Printed transmission lines, passive circuits and radiating elements used in RF circuits are typically formed in one of three ways. One configuration known as microstrip, places the signal line on a board surface and provides a second conductive layer, commonly referred to as a ground plane. A second type of configuration known as buried microstrip is similar except that the signal line is covered with a dielectric substrate material. In a third configuration known as stripline, the signal line is sandwiched between two electrically conductive (ground) planes. Ignoring losses, the characteristic impedance of a transmission line, such as stripline or microstrip, is equal to $\sqrt{L_l/C_l}$ where $L_l$ is the inductance per unit length and $C_l$ is the capacitance per unit length. The values of $L_l$ and $C_l$ are generally determined by the physical geometry and spacing of the line structure as well as the permittivity of the dielectric material(s) used to separate the transmission line structures. Conventional substrate materials typically have a permeability of approximately 1.0.

In conventional RF design, a substrate material is selected that has a relative permittivity value suitable for the design. Once the substrate material is selected, the line characteristic impedance value is exclusively adjusted by controlling the line geometry and physical structure.

Radio frequency (RF) circuits are typically embodied in hybrid circuits in which a plurality of active and passive circuit components are mounted and connected together on a surface of an electrically insulating board substrate such as a ceramic substrate. The various components are generally interconnected by printed metallic conductors of copper, gold, or tantalum, for example that are transmission lines as stripline or microstrip or twin-line structures.

The dielectric constant of the chosen substrate material for a transmission line, passive RF device, or radiating element determines the physical wavelength of RF energy at a given frequency for that line structure. One problem encountered when designing microelectronic RF circuitry is the selection of a dielectric board substrate material that is optimized for all of the various passive components, radiating elements and transmission line circuits to be formed on the board. In particular, the geometry of certain circuit elements may be physically large or miniaturized due to the unique electrical or impedance characteristics required for such elements. For example, many circuit elements or tuned circuits may need to be an electrical ¼ wave. Similarly, the line widths required for exceptionally high or low characteristic impedance values can, in many instances, be too narrow or too wide for practical implementation for a given substrate. Since the physical size of the microstrip or stripline is inversely related to the relative permittivity of the dielectric material, the dimensions of a transmission line can be affected greatly by the choice of substrate board material.

Still, an optimal board substrate material design choice for some components may be inconsistent with the optimal board substrate material for other components, such as antenna elements. Moreover, some design objectives for a circuit component may be inconsistent with one another. For example, it may be desirable to reduce the size of an antenna element. This could be accomplished by selecting a board material with a relatively high permittivity. However, the use of a dielectric with a higher relative permittivity will generally have the undesired effect of reducing the radiation efficiency of the antenna.

An antenna design goal is frequently to effectively reduce the size of the antenna without too great a reduction in radiation efficiency. One method of reducing antena size is through capacitive loading, such as through use of a high dielectric constant substrate for the dipole array elements.

For example, if dipole arms are capacitively loaded by placing them on "high" dielectric constant board substrate portions, the dipole arms can be shortened relative to the arm lengths which would otherwise be needed using a lower dielectric constant substrate. This effect results because the electrical field in high dielectric substrate portion between the arm portion and the ground plane will be concentrated into a smaller dielectric substrate volume.

However, the radiation efficiency, being the frequency dependent ratio of the power radiated by the antenna to the total power supplied to the antenna will be reduced primarily due to the shorter dipole arm length. A shorter arm length reduces the radiation resistance, which is approximately equal to the square of the arm length for a "short" (less the ½ wavelength) dipole antenna as shown below:

$$R_r = 20\pi^2 (l/\lambda)^2$$

where l is the electrical length of the antenna line and $\lambda$ is the wavelength of interest.

A conductive trace comprising a single short dipole can be modeled as an open transmission line having series connected radiation resistance, an inductor, a capacitor and a resistive ground loss. The radiation efficiency of a dipole antenna system, assuming a single mode can be approximated by the following equation:

$$E = \frac{R_r}{(R_r + X_L + X_C + R_L)}$$

Where

E is the efficiency $R_r$ is the radiation resistance $X_L$ is the inductive reactance $X_C$ is the capacitive reactance $X_L$ is the ohmic feed point ground losses and skin effect The radiation resistance is a fictitious resistance that accounts for energy radiated by the antenna. The inductive reactance represents the inductance of the conductive dipole lines, while the capacitor is the capacitance between the conductors. The other series connected components simply turn RF energy into heat, which reduces the radiation efficiency of the dipole.

From the foregoing, it can be seen that the constraints of a circuit board substrate having selected relative dielectric properties often results in design compromises that can negatively affect the electrical performance and/or physical characteristics of the overall circuit. An inherent problem with the conventional approach is that, at least with respect to the substrate, the only control variable for line impedance is the relative permittivity. This limitation highlights an important problem with conventional substrate materials, i.e. they fail to take advantage of the other factor that determines characteristic impedance, namely $L_t$, the inductance per unit length of the transmission line.

Yet another problem that is encountered in RF circuit design is the optimization of circuit components for operation on different RF frequency bands. Line impedances and lengths that are optimized for a first RF frequency band may provide inferior performance when used for other bands, either due to impedance variations and/or variations in electrical length. Such limitations can limit the effective operational frequency range for a given RF system.

Conventional circuit board substrates are generally formed by processes such as casting or spray coating which generally result in uniform substrate physical properties, including the dielectric constant. Accordingly, conventional dielectric substrate arrangements for RF circuits have proven to be a limitation in designing circuits that are optimal in regards to both electrical and physical size characteristics.

SUMMARY OF THE INVENTION

The invention concerns a dipole antenna of reduced size and with improved impedance bandwidth. The antenna is preferably formed on a dielectric substrate having a plurality of regions, each having a characteristic relative permeability and permittivity. First and second dipole radiating element defining conductive paths can be selectively formed on first characteristic regions of the substrate having a first characteristic permeability and first permittivity. A reactive coupling element can be interposed between the dipole radiating elements for reactively coupling the first dipole radiating element to the second dipole radiating element.

The reactive coupling element is coupled to a second characteristic region of the substrate having a second permittivity and second permeability for providing a desired reactance value for the reactive coupling element. The reactive element can be comprised of at least one of a capacitor and an inductor. If the reactive element is comprised of a capacitor, the capacitive coupling can be provided as between adjacent ends of the dipole elements. The capacitive coupling is at least partially determined by the second relative permittivity.

The first and second characteristic regions are different from a third characteristic region of the substrate with regard to at least one of permeability and permittivity. According to one aspect of the invention, at least one of a third permittivity and a third permeability of the third characteristic region are smaller in value, respectively, as compared to at least one of the first and second permittivity and permeability. According to a second aspect of the invention, the third permittivity and third permeability are larger in value, respectively, as compared to at least one of the first and second permittivity and permeability.

According to another aspect of the invention, a metal sleeve element can be disposed on the second characteristic region of the substrate for inductively coupling adjacent ends of the dipole radiating elements. According to a preferred embodiment, the ends define an RF feed point for the dipole radiating elements. The metal sleeve element can be comprised of an elongated metal strip disposed adjacent to at least a portion of the dipole radiating elements. In any case, the inductive coupling is at least partially determined by the second relative permeability.

According to another aspect of the invention, the first permeability and the second permeability can be controlled by the addition of meta-materials to the dielectric substrate. Alternatively, or in addition thereto, the first permittivity and the second permittivity can be controlled by the addition of meta-materials to the dielectric substrate.

The invention can also include other types of antennas formed on dielectric substrates. According to an alternative embodiment, the antenna can be comprised of at least one radiating element, such as a loop, defining a conductive path and selectively formed on first characteristic regions of the substrate having a first characteristic permeability and first permittivity. One or more reactive coupling elements can be interposed between portions of the conductive path that are separated by a gap. The reactive coupling element can be coupled to a second characteristic region of the substrate having a second permittivity and second permeability for providing a desired reactance value for the reactive coupling element. Further, the first and second characteristic regions can be different from a third characteristic region of the substrate with regard to at least one of permeability and permittivity.

DETAILED DESCRIPTION OF THE PREFERRED EMBODIMENTS

Low dielectric constant board materials are ordinarily selected for RF designs. For example, polytetrafluoroethylene (PTFE) based composites such as RT/duroid® 6002 (dielectric constant of 2.94; loss tangent of 0.009) and RT/duroid® 5880 (dielectric constant of 2.2; loss tangent of 0.0007) are both available from Rogers Microwave Products, Advanced Circuit Materials Division, 100 S. Roosevelt Ave, Chandler, Ariz. 85226. Both of these materials are common board material choices. The above board materials provide dielectric layers having relatively low dielectric constants with accompanying low loss tangents.

However, use of conventional board materials can compromise the miniaturization of circuit elements and may also compromise some performance aspects of circuits that can benefit from high dielectric constant layers. A typical tradeoff in a communications circuit is between the physical size of antenna elements versus efficiency. By comparison, the present invention provides the circuit designer with an added level of flexibility by permitting use of a dielectric layer portion with selectively controlled permittivity and permeability properties optimized for efficiency. This added flexibility enables improved performance and antenna element density not otherwise possible.

Figure 1:
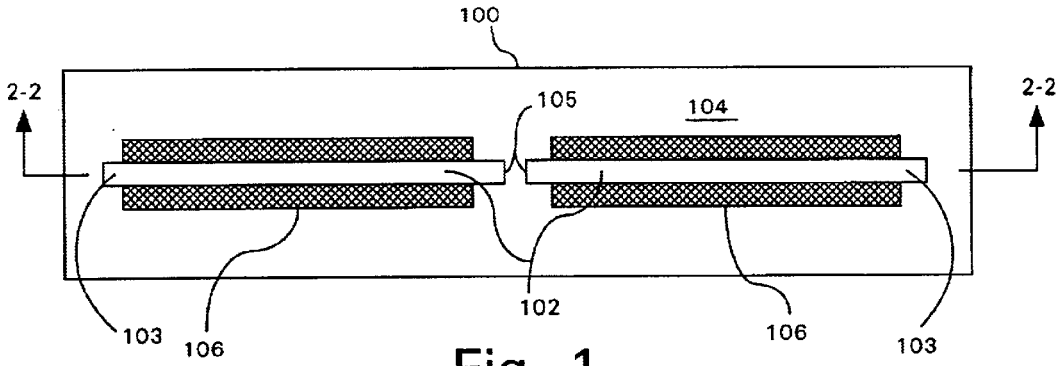
FIG. 1 is a top view of an antenna element formed on a substrate for reducing the size and improving the radiation efficiency of the element.
Figure 3:
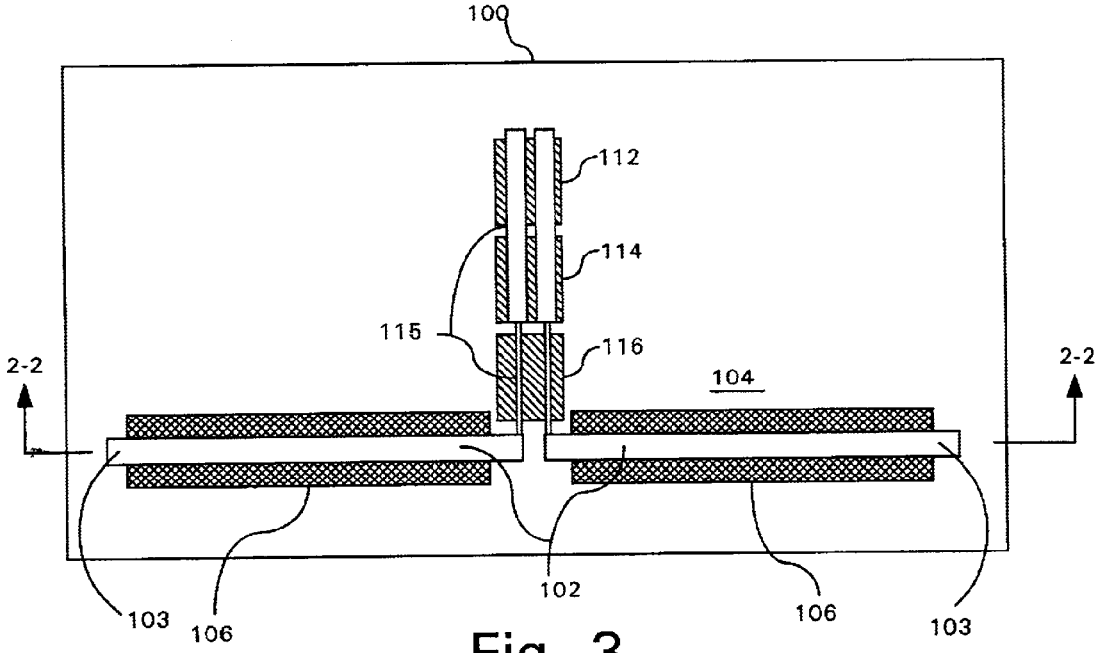
FIG. 3 is a top view of an alternative embodiment of the antenna element in FIG. 1 and associated feed line circuitry.

Referring to FIG. 1, antenna 102 can be comprised of elements 103. The elements 103 can be mounted on dielectric layer 100 as shown or, buried within the dielectric layer 100. In FIG. 1, the antenna 102 is configured as a dipole, but it will be appreciated by those skilled in the art that the invention is not so limited. According to a preferred embodiment, dielectric layer 100 includes first region 104 having a first relative permittivity, and a second region 106 having a second relative permittivity. The first relative permittivity can be different from the second relative permittivity, although the invention is not so limited. A ground plane 110 is preferably provided beneath the antenna 102 and can include openings for the passage of antenna feeds 108. Alternatively, the feed line for the antenna can be disposed directly on the surface of the substrate as shown in FIG. 3. Dielectric material 100 has a thickness that defines an antenna height above ground. The thickness is approximately equal to the physical distance from antenna 102 to the underlying ground plane 110.

Antenna elements 103 and the second region 106 of the dielectric layer are configured so that at least a portion of the antenna elements are positioned on the second region 106 as shown. According to a preferred embodiment, a substantial portion of each antenna element is positioned on the second region 106 as shown.

In order to reduce the physical size of the elements 103, the second relative permittivity of the substrate in the second region 106 can be substantially larger than the first relative permittivity of the dielectric in the first region 104. In general, resonant length is roughly proportional to $1/\sqrt{\epsilon_r}$ where $\epsilon_r$ is the relative permittivity. Accordingly, selecting a higher value of relative permittivity can reduce the physical dimensions of the antenna.

One problem with increasing the relative permittivity in second region 106 is that radiation efficiency of the antenna 102 can be reduced. Microstrip antennas printed on high dielectric constant and relatively thick substrates tend to exhibit poor radiation efficiency. With dielectric substrate having higher values of relative permittivity, a larger amount of the electromagnetic field is concentrated in the dielectric between the conductive antenna element and the ground plane. Poor radiation efficiency under such circumstances is often attributed in part to surface wave modes propagating along the air/substrate interface.

As the size of the antenna is reduced through use of a high dielectric substrate, the net antenna capacitance generally decreases because the area reduction more than offsets the increase in effective permittivity resulting from the use of a higher dielectric constant substrate portion.

The present invention permits formation of dielectric substrates having one or more regions having significant magnetic permeability. Prior substrates generally included materials having relative magnetic permeabilities of approximately 1. The ability to selectively add significant magnetic permeability to portions of the dielectric substrate can be used to increase the inductance of nearby conductive traces, such as transmission lines and antenna elements. This flexibility can be used to improve RF system performance in a number of ways.

For example, in the case of short dipole antennas, dielectric substrate portions having significant relative magnetic permeability can be used to increase the inductance of the dipole elements to compensate for losses in radiation efficiency from use of a high dielectric substrate and the generally resulting higher capacitance. Accordingly, resonance can be obtained, or approached, at a desired frequency by use of a dielectric having a relative magnetic permeability larger than 1. Thus, the invention can be used to improve performance or obviate the need to add a discrete inductor to the system in an attempt to accomplish the same function.

In general it has been found that as substrate permittivity increases from 1, it is desirable to also increase permeability in order for the antenna to more effectively transfer electromagnetic energy from the antenna structure into free space. In this regard, it may be noted that variation in the dielectric constant or permittivity mainly affects the electric field whereas control over the permeability improves the transfer of energy for the magnetic field.

For greater radiation efficiency, it has been found that the permeability can be increased roughly in accordance with the square root of the permittivity. For example, if a substrate were selected with a permittivity of 9, a good starting point for an optimal permeability would be 3. Of course, those skilled in the art will recognize that the optimal values in any particular case will be dependent upon a variety of factors including the precise nature of the dielectric structure above and below the antenna elements, the dielectric and conductive structure surrounding the antenna elements, the height of the antenna above the ground plane, width of the dipole arm, and so on. Accordingly, a suitable combination of optimum values for permittivity and permeability can be determined experimentally and/or with computer modeling.

Figure 2:
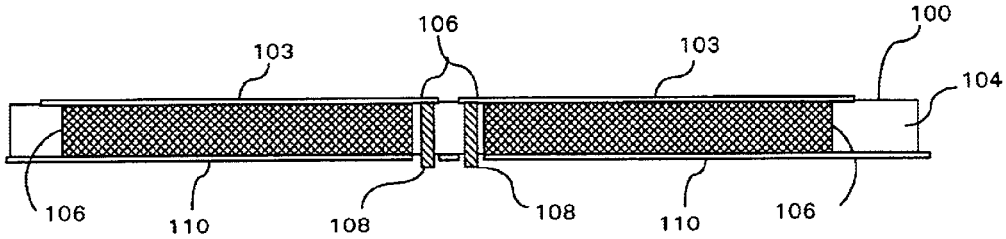
FIG. 2 is a cross-sectional view of an antenna element of FIG. 1 taken along line 2—2.

Those skilled in the art will recognize that the foregoing technique is not limited to use with dipole antennas such as those shown in FIGS. 1 and 2. Instead, the foregoing technique can be used to produce efficient antenna elements of reduced size in other types of substrate structures. For example, rather than residing exclusively on top of the substrate as shown in FIGS. 1 and 2, the antenna elements 103 can be partially or entirely embedded within the second region 106 of the dielectric layer.

According to a preferred embodiment, the relative permittivity and/or permeability of the dielectric in the second region 106 can be different from the relative permittivity and permeability of the first region 104. Further, at least a portion of the dielectric substrate 100 can be comprised of one or more additional regions on which additional circuitry can be provided. For example, in FIG. 3, region 112, 114, 116 can support antenna feed circuitry 115, which can include a balun, a feed line or an impedance transformer. Each region 112, 114, 116 can have a relative permittivity and permeability that is optimized for the physical and electrical characteristics required for each of the respective components.

Figure 7:
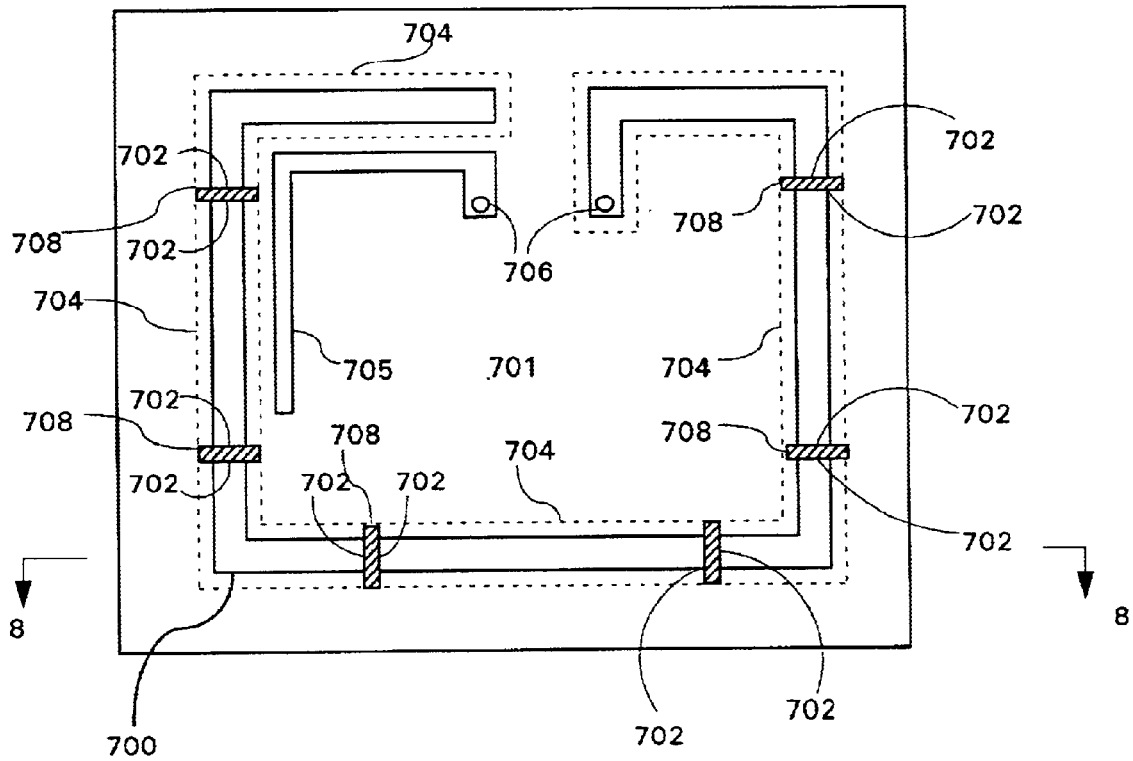
FIG. 7 is a top view of a further alternative embodiment of the invention in which a series of reactive elements have been interposed along the length of a loop radiating element.
Figure 8:
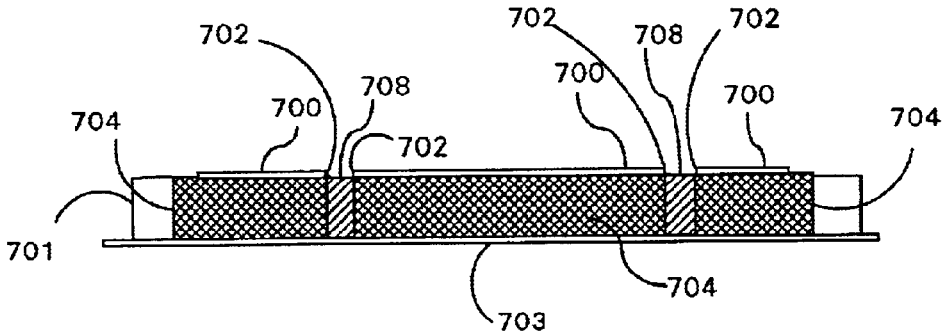
FIG. 8 is a cross-sectional view of the alternative embodiment of FIG. 7 taken along line 8—8.

Likewise, these techniques can be used for any other type of substrate antennas, the dipole of FIG. 1 being merely one example. Another example is a loop antenna, as shown in FIGS. 7 and 8, in which the permittivity and permeability of the substrate beneath the radiating elements and/or feed circuitry is selectively controlled for reduced size with high radiation efficiency. In FIG. 7 a loop antenna element 700 having a feed point 506 and a matching balun 705 is shown mounted on a dielectric substrate 701. A ground plane 703 can be provided beneath the substrate as illustrated. According to a preferred embodiment, the dielectric substrate region 704 beneath the loop antenna element 700 can have a permittivity and permeability that is different from the surrounding substrate 701. The increased permittivity in region 704 can reduce the size of the antenna element 700 for a given operating frequency. In order to maintain satisfactory radiation efficiency however, the permeability in region 704 can be increased in a manner similar to that described above with respect to the dipole antenna.

Alternatively, or in addition to, the modifications to the dielectric substrate beneath the antenna elements, other features of antenna performance can be improved by advantageously controlling the characteristics of selected portions of the substrate. For example, in conventional dipole antenna systems, it is known that a chip capacitor can be connected between the adjacent ends of the two antenna elements. The addition of a capacitor bridging the antenna elements in this location is advantageous as it can improve the impedance bandwidth of the antenna. Those skilled in the art are generally familiar with the techniques for selection of a suitable value of capacitance for achieving performance improvements. However, as operating frequencies increase, the necessary value of the coupling capacitor that would need to be provided between the adjacent ends can become extremely small. The result is that the proper capacitance value cannot be achieved using conventional lumped circuit components, such as chip capacitors.

Figure 5:
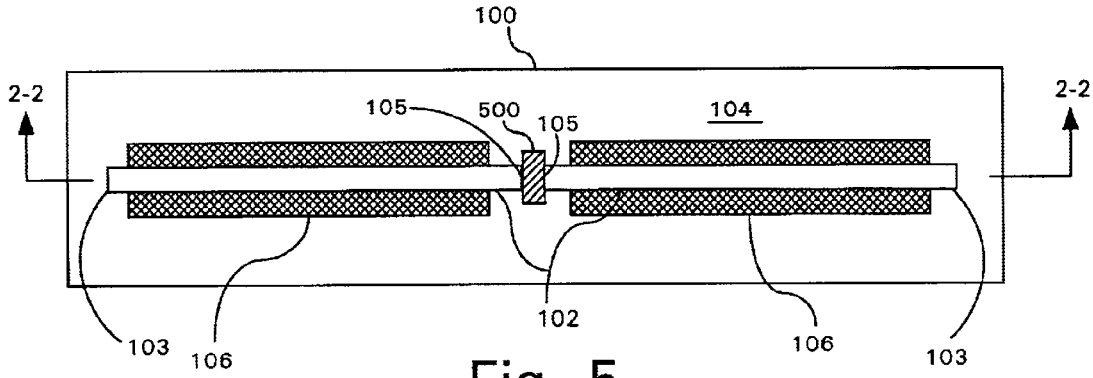
FIG. 5 is a top view of an alternative embodiment of the invention in which a capacitor has been added between the antenna elements to improve the impedance bandwidth.
Figure 6:
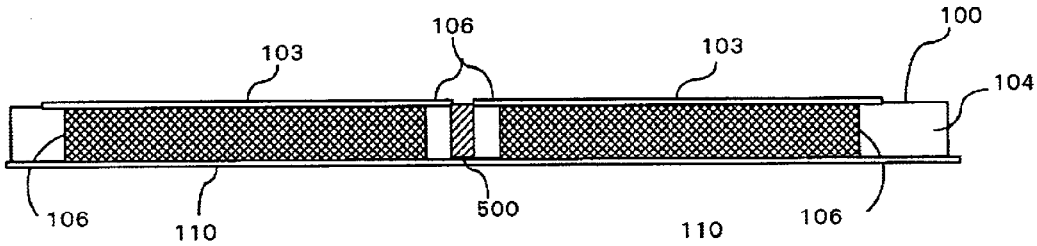
FIG. 6 is a cross-sectional view of the alternative embodiment of FIG. 5 taken along line 6—6.

Referring to FIG. 1, a certain amount of capacitance will inherently exist between the adjacent ends 105. However, the spacing of the ends 105 and the relatively low permittivity of the substrate 100 will generally be such that this inherent capacitance will not be the value necessary for optimizing the impedance bandwidth necessary for a particular application. Accordingly, FIG. 5 is a top view of an alternative embodiment of the invention in which the permittivity in region 500 can be selectively controlled. FIG. 6 is a cross-sectional view of the alternative embodiment of FIG. 5 taken along line 6—6. Common reference numbers in FIGS. 1–2 and 5–6 are used to identify common elements in FIGS. 5 and 6.

By selectively controlling the permittivity of the substrate in the region 500 as shown, it is possible to increase or decrease the inherent capacitance that exists between the ends 105 of dipole elements 103. The result is an improved impedance bandwidth that cannot otherwise be achieved using conventional lumped element means. The limits of region 500 are shown in FIGS. 5 and 6 as extending only between the adjacent ends 105 of the antenna elements 103. It will be appreciated by those skilled in the art that the invention is not so limited. Rather, the limits of region 500 can extend somewhat more or less relative to the ends of the dipole elements 105 without departing from the intended scope of the invention. For example, the region 500 can include a portion of the region below the ends of antenna elements 105. Alternatively, only a portion of the region between the ends 105 can be modified so as to have different permittivity characteristics.

A similar technique for improving the impedance bandwidth can also be applied to loop antennas. In the case of loop antennas, it is conventional to interpose capacitors along the conductive path defining the radiating element for the loop. In a conventional loop antenna, the referenced capacitors would typically be connected between adjacent end portions 702 of antenna element 700 as shown in FIGS. 7 and 8. However, as the design frequency of the antenna increases, the capacitor values necessary to implement these techniques can become too small to permit use of lumped element components such as chip capacitors.

According to a preferred embodiment shown in FIGS. 7 and 8, the permittivity in regions 708 can be selectively controlled to adjust the inherent capacitive coupling that exists between end portions 702. For example, if the permittivity of the substrate in regions 708 is increased, the inherent capacitance between ends 702 can be increased. In this way, the necessary capacitance can be provided to improve the impedance bandwidth by making use of, and selectively controlling, the inherent capacitance between end portions 702. Those skilled in the art will appreciate that the region 708 can be somewhat smaller than, or can extend somewhat past, the limits defined by end portions 702.

Figure 9:
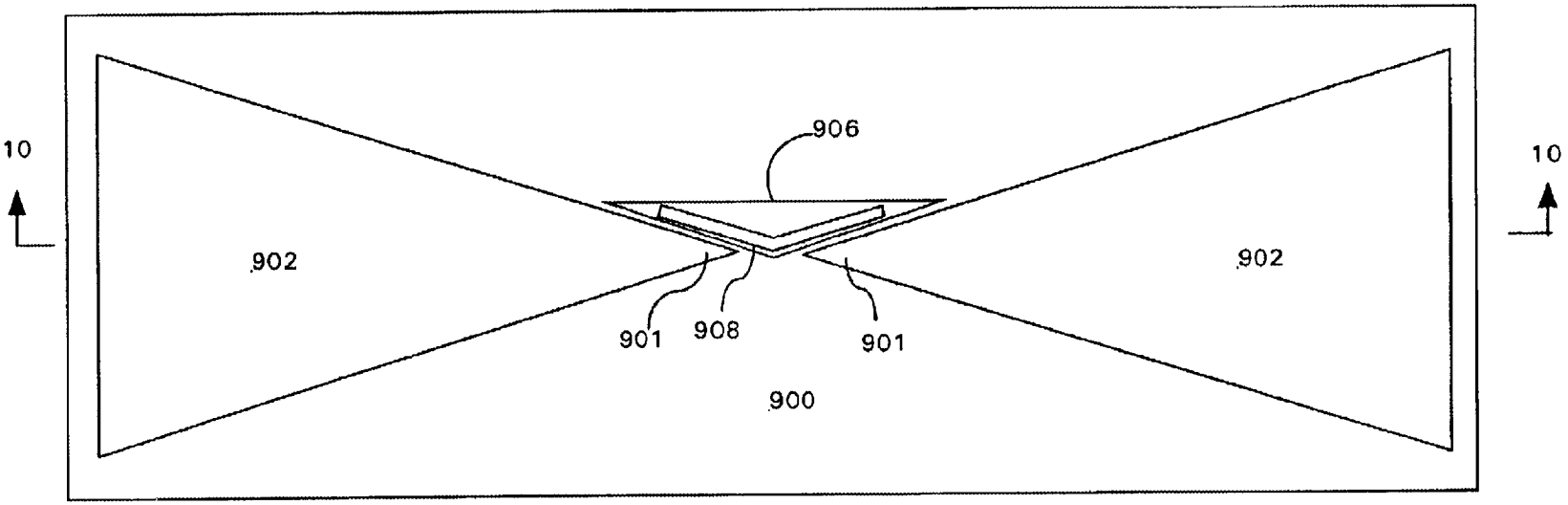
FIG. 9 is a top view of another alternative embodiment of the invention in which a sleeve element has been added.
Figure 10:
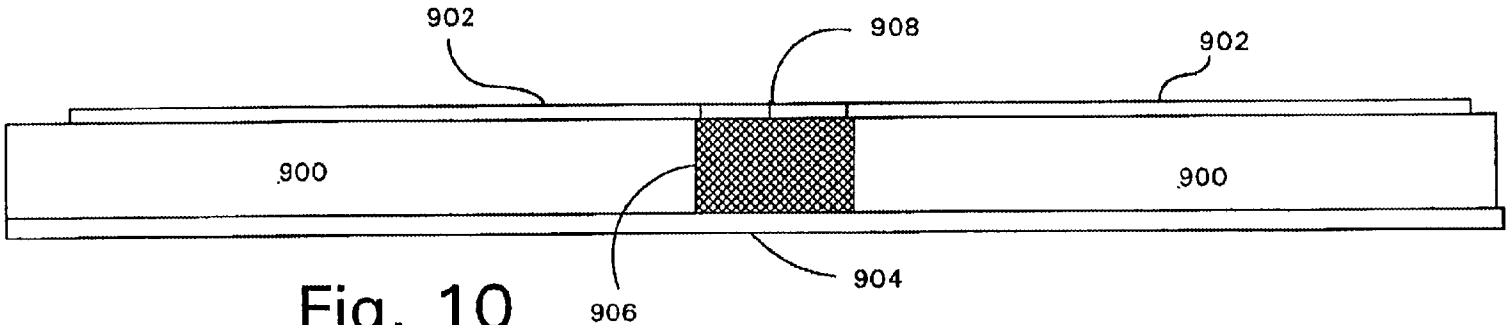
FIG. 10 is a cross-section view of the alternative embodiment of FIG. 9 taken along lines 10—10.

Another alternative embodiment of the invention is illustrated in FIGS. 9 and 10 where dipole elements 902 are mounted on a substrate 900. Dipole elements 902 can have a feed point 901 as is well known in the art. A ground plane 904 can be provided beneath the substrate as shown. It is known in the art that improvements to the input impedance bandwidth of an antenna can be achieved by the use of capacitive and inductive coupling at the adjacent ends of dipole elements. In FIGS. 9 and 10, this capacitive coupling is achieved using a modified dielectric region 906 with a higher permittivity as compared to surrounding substrate 900. This higher permittivity can improve capacitive coupling between dipole elements 902 in much the same way as previously described relative to FIGS. 5 and 6.

Further, the invention can make use of a conventional sleeve element 908 to provide inductive coupling. According to a preferred embodiment, however, the permeability of the modified dielectric region 906 can be selectively controlled. For example, the permeability can be increased to have a value larger than 1. Alternatively, the permeability in region 906 can be controlled so as to vary along the length of the inductive element 908. In any case, the coupling between the "sleeve" and the dipole arm can be improved and controlled by selectively adjusting the dielectric of the substrate between the sleeve and the dipole arm to improve the impedance bandwidth. The incorporation of permeable materials beneath the sleeve would allow for the control of line widths that might not otherwise be achievable without the use of magnetic materials. This control over the permittivity and permeability can provide the designer with greater flexibility to provide improved broadband impedance matching.

The inventive arrangements for integrating reactive capacitive and inductive components into a dielectric circuit board substrate are not limited for use with the antennas as shown. Rather, the invention can be used with a wide variety of other circuit board components requiring small amounts of carefully controlled inductance and capacitance.

Figure 4:
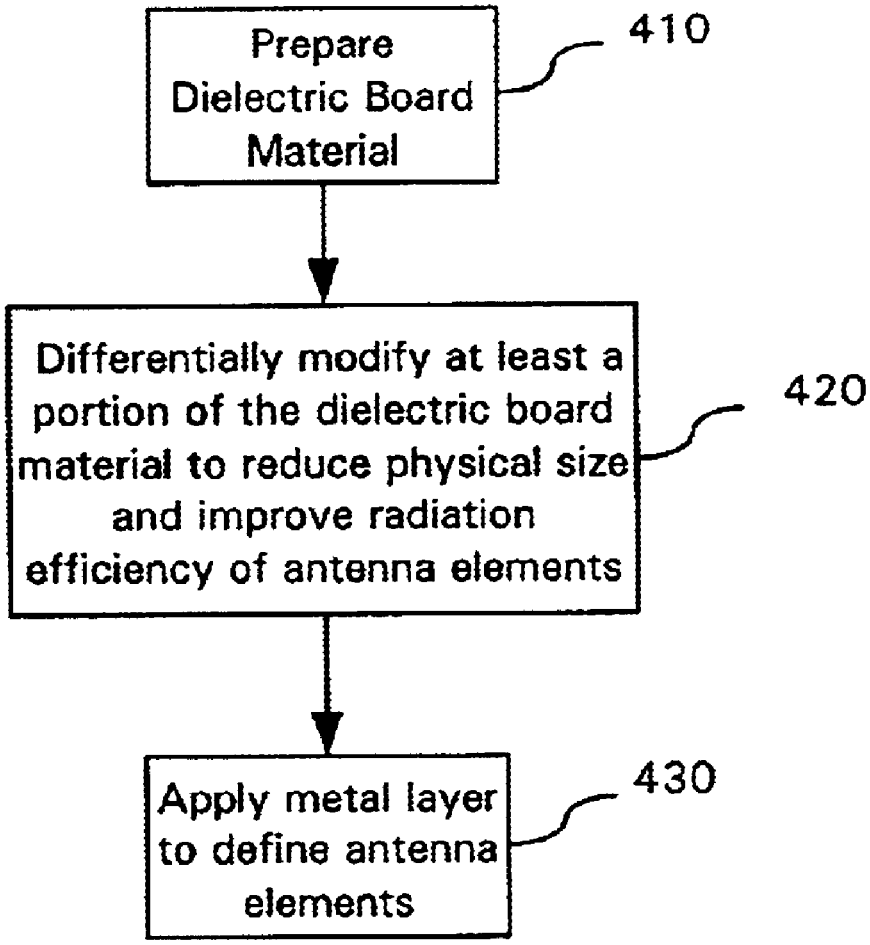
FIG. 4 is a flow chart that is useful for illustrating a process for manufacturing an antenna of reduced physical size and high radiation efficiency.

Dielectric substrate boards having metamaterial portions providing localized and selectable magnetic and dielectric properties can be prepared as shown in FIG. 4. In step 410, the dielectric board material can be prepared. In step 420, at least a portion of the dielectric board material can be differentially modified using meta-materials, as described below, to reduce the physical size and achieve the best possible efficiency for the antenna elements and associated feed circuitry. Finally, a metal layer can be applied to define the conductive traces associated with the antenna elements and associated feed circuitry.

As defined herein, the term "metamaterials" refers to composite materials formed from the mixing or arrangement of two or more different materials at a very fine level, such as the Angstrom or nanometer level. Metamaterials allow tailoring of electromagnetic properties of the composite, which can be defined by effective electromagnetic parameters comprising effective electrical permittivity (or dielectric constant) and the effective magnetic permeability.

The process for preparing and differentially modifying the dielectric board material as described in steps 410 and 420 shall now be described in some detail. It should be understood, however, that the methods described herein are merely examples and the invention is not intended to be so limited.

Appropriate bulk dielectric substrate materials can be obtained from commercial materials manufacturers, such as DuPont and Ferro. The unprocessed material, commonly called Green Tape™, can be cut into sized portions from a bulk dielectric tape, such as into 6 inch by 6 inch portions. For example, DuPont Microcircuit Materials provides Green Tape material systems, such as Low-Temperature Cofire Dielectric Tape. These substrate materials can be used to provide dielectric layers having relatively moderate dielectric constants with accompanying relatively low loss tangents for circuit operation at microwave frequencies once fired.

In the process of creating a microwave circuit using multiple sheets of dielectric substrate material, features such as vias, voids, holes, or cavities can be punched through one or more layers of tape. Voids can be defined using mechanical means (e.g. punch) or directed energy means (e.g., laser drilling, photolithography), but voids can also be defined using any other suitable method. Some vias can reach through the entire thickness of the sized substrate, while some voids can reach only through varying portions of the substrate thickness.

The vias can then be filled with metal or other dielectric or magnetic materials, or mixtures thereof, usually using stencils for precise placement. The individual layers of tape can be stacked together in a conventional process to produce a complete, multi-layer substrate.

The choice of a metamaterial composition can provide effective dielectric constants over a relatively continuous range from less than 2 to about 2650. Materials with magnetic properties are also available. For example, through choice of suitable materials the relative effective magnetic permeability generally can range from about 4 to 116 for most practical RF applications. However, the relative effective magnetic permeability can be as low as about 2 or reach into the thousands.

The term "differentially modified" as used herein refers to modifications, including dopants, to a dielectric substrate layer that result in at least one of the dielectric and magnetic properties being different at one portion of the substrate as compared to another portion. A differentially modified board substrate preferably includes one or more metamaterial containing regions.

For example, the modification can be selective modification where certain dielectric layer portions are modified to produce a first set of dielectric or magnetic properties, while other dielectric layer portions are modified differentially or left unmodified to provide dielectric and/or magnetic properties different from the first set of properties. Differential modification can be accomplished in a variety of different ways.

According to one embodiment, a supplemental dielectric layer can be added to the dielectric layer. Techniques known in the art such as various spray technologies, spin-on technologies, various deposition technologies or sputtering can be used to apply the supplemental dielectric layer. The supplemental dielectric layer can be selectively added in localized regions, including inside voids or holes, or over the entire existing dielectric layer. For example, a supplemental dielectric layer can be used for providing a substrate portion having an increased effective dielectric constant.

The differential modifying step can further include locally adding additional material to the dielectric layer or supplemental dielectric layer. The addition of material can be used to further control the effective dielectric constant or magnetic properties of the dielectric layer to achieve a given design objective.

The additional material can include a plurality of metallic and/or ceramic particles. Metal particles preferably include iron, tungsten, cobalt, vanadium, manganese, certain rare-earth metals, nickel or niobium particles. The particles are preferably nanometer size particles, generally having sub-micron physical dimensions, hereafter referred to as nanoparticles.

The particles, such as nanoparticles, can preferably be organofunctionalized composite particles. For example, organofunctionalized composite particles can include particles having metallic cores with electrically insulating coatings or electrically insulating cores with a metallic coating. Magnetic metamaterial particles that are generally suitable for controlling magnetic properties of dielectric layer for a variety of applications described herein include ferrite organoceramics (FexCyHz)-(Ca/Sr/Ba-Ceramic). These particles work well for applications in the frequency range of 8–40 GHz. Alternatively, or in addition thereto, niobium organoceramics (NbCyHz)-(Ca/Sr/Ba-Ceramic) are useful for the frequency range of 12–40 GHz. The materials designated for high frequency are also applicable to low frequency applications. These and other types of composite particles can be obtained commercially.

In general, coated particles are preferable for use with the present invention as they can aid in binding with a polymer (e.g. LCP) matrix or side chain moiety. In addition to controlling the magnetic properties of the dielectric, the added particles can also be used to control the effective dielectric constant of the material. Using a fill ratio of composite particles from approximately 1 to 70%, it is possible to raise and possibly lower the dielectric constant of substrate dielectric layer and/or supplemental dielectric layer portions significantly. For example, adding organofunctionalized nanoparticles to a dielectric layer can be used to raise the dielectric constant of the modified dielectric layer portions.

Particles can be applied by a variety of techniques including polyblending, mixing and filling with agitation. For example, if the dielectric layer includes a LCP, the dielectric constant may be raised from a nominal LCP value of 2 to as high as 10 by using a variety of particles with a fill ratio of up to about 70%.

Metal oxides useful for this purpose can include aluminum oxide, calcium oxide, magnesium oxide, nickel oxide, zirconium oxide and niobium (II, IV and V) oxide. Lithium niobate ($LiNbO_3$), and zirconates, such as calcium zirconate and magnesium zirconate, also may be used.

The selectable dielectric properties can be localized to areas as small as about 10 nanometers, or cover large area regions, including the entire board substrate surface. Conventional techniques such as lithography and etching along with deposition processing can be used for localized dielectric and magnetic property manipulation.

Materials can be prepared mixed with other materials or including varying densities of voided regions (which generally introduce air) to produce effective dielectric constants in a substantially continuous range from 2 to about 2650, as well as other potentially desired substrate properties. For example, materials exhibiting a low dielectric constant (<2 to about 4) include silica with varying densities of voided regions. Alumina with varying densities of voided regions can provide a dielectric constant of about 4 to 9. Neither silica nor alumina have any significant magnetic permeability. However, magnetic particles can be added, such as up to 20 wt. %, to render these or any other material significantly magnetic. For example, magnetic properties may be tailored with organofunctionality. The impact on dielectric constant from adding magnetic materials generally results in an increase in the dielectric constant.

Medium dielectric constant materials have a dielectric constant generally in the range of 70 to 500+/−10%. As noted above these materials may be mixed with other materials or voids to provide desired effective dielectric constant values. These materials can include ferrite doped calcium titanate. Doping metals can include magnesium, strontium and niobium. These materials have a range of 45 to 600 in relative magnetic permeability.

For high dielectric constant applications, ferrite or niobium doped calcium or barium titanate zirconates can be used. These materials have a dielectric constant of about 2200 to 2650. Doping percentages for these materials are generally from about 1 to 10%. As noted with respect to other materials, these materials may be mixed with other materials or voids to provide desired effective dielectric constant values.

These materials can generally be modified through various molecular modification processing. Modification processing can include void creation followed by filling with materials such as carbon and fluorine based organo functional materials, such as polytetrafluoroethylene PTFE.

Alternatively or in addition to organofunctional integration, processing can include solid freeform fabrication (SFF), photo, uv, x-ray, e-beam or ion-beam irradiation. Lithography can also be performed using photo, uv, x-ray, e-beam or ion-beam radiation.

Different materials, including metamaterials, can be applied to different areas, so that a plurality of areas of the substrate layers have different dielectric and/or magnetic properties. The backfill materials, such as noted above, may be used in conjunction with one or more additional processing steps to attain desired, dielectric and/or magnetic properties, either locally or over a bulk substrate portion.

A top layer conductor print is then generally applied to the modified substrate layer. Conductor traces can be provided using thin film techniques, thick film techniques, electroplating or any other suitable technique. The processes used to define the conductor pattern include, but are not limited to standard lithography and stencil.

A base plate is then generally obtained for collating and aligning a plurality of modified board substrates.

The plurality of layers of substrate can then be laminated (e.g. mechanically pressed) together using either isostatic pressure, which puts pressure on the material from all directions, or uniaxial pressure, which puts pressure on the material from only one direction. The laminate substrate is then is further processed as described above or placed into an oven to be fired to a temperature suitable for the processed substrate (approximately 850 C. to 900 C. for the materials cited above).

The plurality of ceramic tape layers can be controlled to rise in temperature at a rate suitable for the substrate materials used. The process conditions used, such as the rate of increase in temperature, final temperature, cool down profile, and any necessary holds, are selected mindful of the substrate material and any material deposited thereon. Following firing, stacked substrate boards, typically, are inspected for flaws using an optical microscope.

The stacked ceramic substrates can then be optionally diced into cingulated pieces as small as required to meet circuit functional requirements. Following final inspection, the cingulated substrate pieces can then be mounted to a test fixture for evaluation of their various characteristics, such as to assure that the dielectric, magnetic and/or electrical characteristics are within specified limits.

Thus, dielectric substrate materials can be provided with localized tunable dielectric and/or magnetic characteristics for improving the density and performance of circuits. The dielectric flexibility allows independent optimization of the feed line impedance and dipole antenna elements.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

What is claimed is:

1. A dipole antenna with improved impedance bandwidth, comprising:

a dielectric substrate having a plurality of regions, each region having a characteristic permeability and permittivity;

a first and second dipole radiating element defining conductive paths and selectively formed on first characteristic regions of said substrate having a first permeability and a first permittivity;

a reactive coupling element interposed between said dipole radiating elements for reactively coupling said first dipole radiating element to said second dipole radiating element said reactive coupling element coupled to a second characteristic region of said substrate having a second permittivity and a second permeability for providing a desired reactance value for said reactive coupling element; and wherein said first and second characteristic regions are different from a third characteristic region of said substrate with regard to permeability.

2. The antenna according to claim 1 wherein a third permeability of said third characteristic region is smaller in value as compared to at least one of said first and second permeability.

3. The antenna according to claim 1 wherein a third permeability of said third characteristic regions is larger in value as compared to at least one of said first and second permeability.

4. The antenna according to claim 1 wherein said reactive element is comprised of at least one of a capacitor and an inductor.

5. The antenna according to claim 1 wherein said reactive element is comprised of capacitive coupling between adjacent ends of said dipole elements.

6. The antenna according to claim 5 wherein said capacitive coupling is at least partially determined by said second permittivity.

7. The antenna according to claim 1 further comprising a metal sleeve element disposed on said second characteristic region of said substrate for inductively coupling adjacent ends of said dipole radiating elements.

8. The antenna according to claim 7 wherein said metal sleeve element is comprised of an elongated metal strip disposed adjacent to at least a portion of said dipole radiating elements.

9. The antenna according to claim 7 wherein said inductive coupling is at least partially determined by said second permeability.

10. The antenna according to claim 7 wherein said ends define an RF feed point for said dipole radiating elements.

11. The antenna according to claim 1 wherein at least one of said first permeability and said second permeability are controlled by the addition of meta-materials to said dielectric substrate.

12. The antenna according to claim 1 wherein at least one of said first permittivity and said second permittivity are controlled by the addition of meta-materials to said dielectric substrate.

13. An antenna, comprising;

a dielectric substrate having a plurality of regions, each having a characteristic permeability and permittivity;

at least one radiating element defining a conductive path and selectively formed on first characteristic regions of said substrate having a first permeability and first permittivity;

at least one reactive coupling element interposed between portions of said conductive path separated by a gap, said reactive coupling element coupled to a second characteristic region of said substrate having a second permittivity and second permeability for providing a desired reactance value for said reactive coupling element; and wherein said first and second characteristic regions are different from a third characteristic region of said substrate with regard to permeability.

14. The antenna according to claim 13 wherein a third permeability of said third characteristic region is smaller in value as compared to at least one of said first and second permeability.

15. The antenna according to claim 13 wherein a third permeability of said third characteristic regions is larger in value as compared to at least one of said first and second permeability.

16. The antenna according to claim 13 wherein said reactive element is comprised of at least one of a capacitor and an inductor.

17. The antenna according to claim 13 wherein said reactive element is comprised of capacitive coupling between adjacent ends of said conductive path separated by said gap.

18. The antenna according to claim 17 wherein said capacitive coupling is at least partially determined by said second permittivity.

19. The antenna according to claim 13 wherein at least one of said first permeability and said second permeability are controlled by the addition of meta-materials to said dielectric substrate.

20. The antenna according to claim 13 wherein at least one of said first permittivity and said second permittivity are controlled by the addition of meta-materials to said dielectric substrate.

* * * * *